US008726810B2

(12) United States Patent
Kravel

(10) Patent No.: US 8,726,810 B2
(45) Date of Patent: May 20, 2014

(54) GRENADE HAVING SAFETY LEVER WITH INTEGRATED FIRING PIN RETAINING CLIP

(75) Inventor: Jacob Kravel, Great Neck, NY (US)

(73) Assignee: Combined Systems, Inc., Jamestown, PA (US)

( * ) Notice: Subject to any disclaimer, the term of this patent is extended or adjusted under 35 U.S.C. 154(b) by 0 days.

(21) Appl. No.: 13/423,509

(22) Filed: Mar. 19, 2012

(65) Prior Publication Data

US 2013/0239838 A1 Sep. 19, 2013

(51) Int. Cl.
*F42C 15/20* (2006.01)
*F42B 27/00* (2006.01)

(52) U.S. Cl.
USPC ..... 102/487; 102/482; 102/260

(58) Field of Classification Search
USPC ..... 102/368, 482, 487, 498, 502, 529, 260, 102/261
See application file for complete search history.

(56) References Cited

U.S. PATENT DOCUMENTS

| | | | | |
|---|---|---|---|---|
| 2,203,640 | A * | 6/1940 | Hines et al. | 102/261 |
| 3,434,421 | A * | 3/1969 | Berlin et al. | 102/487 |
| 3,731,631 | A * | 5/1973 | Berlin et al. | 102/487 |
| 3,765,337 | A * | 10/1973 | Padula | 102/487 |
| 3,823,669 | A * | 7/1974 | Zacharin | 102/221 |
| 4,285,277 | A | 8/1981 | Lerman | |
| 4,506,606 | A | 3/1985 | Caruso | |
| 4,926,752 | A | 5/1990 | DiRubbio et al. | |
| 4,947,753 | A | 8/1990 | Nixon, III | |
| 5,196,649 | A | 3/1993 | DiRubbio et al. | |
| 5,433,646 | A | 7/1995 | Tarng | |
| 5,654,523 | A | 8/1997 | Brunn | |
| 5,965,839 | A | 10/1999 | Vasel et al. | |
| 6,202,562 | B1 | 3/2001 | Brunn et al. | |
| 6,349,650 | B1 * | 2/2002 | Brunn et al. | 102/368 |
| 6,374,741 | B1 | 4/2002 | Stanley et al. | |
| 6,374,742 | B1 | 4/2002 | Brunn et al. | |
| 6,386,113 | B1 | 5/2002 | Pinney | |
| 6,752,086 | B2 | 6/2004 | Kravel et al. | |
| 6,755,133 | B1 | 6/2004 | Brunn et al. | |
| 6,767,108 | B1 | 7/2004 | Blachowski et al. | |
| 6,792,868 | B2 * | 9/2004 | Teilhol et al. | 102/487 |
| 7,025,001 | B2 | 4/2006 | Brunn | |
| 7,040,236 | B2 * | 5/2006 | Oh | 102/498 |
| 7,089,863 | B1 | 8/2006 | Dindl | |
| 7,089,864 | B2 | 8/2006 | Brunn et al. | |
| 7,207,276 | B1 | 4/2007 | Dindl | |
| 7,280,340 | B2 | 10/2007 | Smith et al. | |

(Continued)

OTHER PUBLICATIONS

Hand Grenades; Gary W. Cooke; Gary's U.S. Infantry Weapons Reference Guide; http://www.inetres.com/gp/military/infantry/grenade/hand.html; © 2004-2007; 28 pages.

(Continued)

*Primary Examiner* — James Bergin
(74) *Attorney, Agent, or Firm* — Hiscock & Barclay, LLP

(57) ABSTRACT

A grenade includes a body having at least one interior chamber; a fuze assembly attached to the body, that fuze assembly being capable of detonating the grenade and a safety lever movable between a first position to a second position which engages the fuze assembly. A firing pin is engageable with the safety lever to prevent the lever from being moved to the second position. A retaining clip retains the firing pin and prevents premature release of the pin from the grenade wherein the retaining clip is integrated within the safety lever.

10 Claims, 6 Drawing Sheets

(56) References Cited

U.S. PATENT DOCUMENTS

| | | | | |
|---|---|---|---|---|
| 7,287,475 | B2 | 10/2007 | Brunn | |
| 7,354,271 | B2 | 4/2008 | Brunn | |
| 7,444,941 | B1 | 11/2008 | Brunn et al. | |
| 7,461,597 | B2 | 12/2008 | Brunn | |
| 8,136,437 | B2 * | 3/2012 | Van Stratum et al. | 86/1.1 |
| 2002/0088367 | A1 | 7/2002 | MacAleese et al. | |
| 2005/0066849 | A1 | 3/2005 | Kapeles et al. | |
| 2005/0115387 | A1 | 6/2005 | Smith et al. | |
| 2005/0188593 | A1 | 9/2005 | Cerovic et al. | |
| 2006/0081147 | A1 | 4/2006 | Walsh | |
| 2007/0266883 | A1 | 11/2007 | Law et al. | |
| 2008/0006171 | A1 | 1/2008 | Confer | |
| 2008/0178728 | A1 | 7/2008 | Kapeles et al. | |
| 2008/0178758 | A1 | 7/2008 | Kapeles et al. | |
| 2008/0216699 | A1 | 9/2008 | McAleer et al. | |
| 2009/0101038 | A1 | 4/2009 | Kapeles et al. | |
| 2013/0104766 | A1 * | 5/2013 | Thomas | 102/487 |
| 2013/0186295 | A1 * | 7/2013 | Kravel | 102/487 |

OTHER PUBLICATIONS

Penn Arms; A Division of Combined Systems Inc.; Hans Kornberger; Dedicated to Your Mission Product Catalog; www.pennarms.com; © 2009 Penn Arms; 8 pages.

* cited by examiner

GRENADE HAVING SAFETY LEVER WITH INTEGRATED FIRING PIN RETAINING CLIP

TECHNICAL FIELD

The invention relates generally to the field of grenades, cartridges and other diversionary/distraction devices and more specifically to a device that can be launched either by hand or apparatus, the device having an integrated safety lever and firing pin retaining clip assembly.

BACKGROUND AND RELEVANT ART

There are numerous versions of grenades that are presently available for purposes of law enforcement, military and other related applications. Included among these devices are what are referred to as so called "non lethal" or distraction/diversionary devices. These devices include, among others, "flash-bang" grenades and "stun" grenades, each of which are commonly designed to temporarily incapacitate a person or persons that are within a prescribed area or to cause persons to leave a prescribed area due to the detonation of a grenade therein. In the case of "flash bang" grenades, a combination of a released charge of intense illumination and auditory (loud sound) discharge are emitted by the grenade while in the case of "stun" grenades, a plurality of hardened rubberized pellets are caused to be released at high speed when the grenade is detonated over a circular radial pattern. Other non-lethal versions can include those containing at least one of or combinations of chemical (e.g., tear gas) and other deterrent filler materials that are intended to cause considerable discomfort.

In the common course of use, each of the above-noted grenades is provided with a fuze assembly, which permits detonation of the device after a timed delay (i.e., a few seconds) following the release of an arming pin and a safety lever. The safety lever is initially restricted from movement to an firing position by the presence of the arming pin. To avoid any premature release of the arming or firing pin, a retaining clip is typically also provided. The retaining clip releasably retains an outer ring portion of the arming pin, requiring the user to first release the arming pin from the retaining clip by means of a combined rotational and axial movement of the pin. Upon release of the arming pin, the safety lever is unlocked and can be pushed inwardly by the user toward the grenade body to the firing position. The safety lever is biased by a striker spring wherein release of the lever causes subsequent upward movement of the lever from a rest position on the part of the user or a launcher device can then initiate the fuze assembly in order to detonate the grenade.

In the foregoing design, the retaining clip is attached to the grenade body by means of a separate component which is placed in overlaying relation relative to the fuze assembly of the grenade during assembly thereof. As such and particularly in the instances of non-lethal grenades, the safety lever would remain with the grenade fuze upon detonation, which could lead to a build-up of pressure as a result of the retaining clip blocking the top venting ports of the grenade. This build-up of pressure could have two effects. First, it could break the fuze body which would cause the actual fuze body to separate and be thrown clear from the grenade upon detonation, becoming a dangerous projectile and creating potential for injury. Second and as pressure is blocked at the top of the grenade, it could build-up additional pressure at the bottom ports of the grenade, thereby permitting the grenade to move on the floor. It is therefore a general need in the field to improve the overall manufacturability and safety in the use of grenades, particularly non-lethal versions, but without sacrificing the ability to prevent premature or inadvertent detonation of these devices.

SUMMARY

Therefore and according to one aspect as described herein, a grenade is provided, said grenade comprising a housing, containing a fuze assembly having means for causing detonation of said grenade, a safety lever attached to said housing and engageable with said fuze assembly, an arming pin that locks said lever and a firing pin retaining clip that retains said arming pin to prevent release of said safety lever, wherein said firing pin retaining clip is integrated within the safety lever.

The grenade according to one version thereof is a non-lethal grenade. The safety lever can be fabricated with the firing pin retaining clip therein or the retaining clip can be fastened or otherwise secured directly to the safety lever during assembly thereof.

According to another aspect, there is provided a safety lever for a grenade said safety lever comprising means for engaging a fuze assembly of said grenade and a retaining clip for a firing pin of said grenade. The safety lever is configured to move between a first position and a second position relative to a fuze assembly of said grenade to cause detonation thereof, said safety lever further including means for retaining an arming pin of said grenade which locks said safety lever in said first position.

One advantage provided is greater ease in the manufacture of grenades by assimilating the above-noted safety functions within a single component, but without sacrificing reliability or functionality of the grenade. That is, the herein described safety lever includes a retaining clip that permits an arming pin of the grenade to lock the safety lever in a first or non-firing position wherein the lever continues to operate upon release of the arming pin to be caused to move between the first position and an arming position in which the fuze assembly of the grenade can be engaged. By maintaining the retaining clip within the safety lever itself and not providing a separate component, the retaining clip is maintained and released immediately after engagement with the fuze assembly based on a hinged connectivity of the safety lever with the grenade body. As a result, there is no chance of the retaining clip becoming a dangerous projectile when the grenade detonates, a clear preference, especially in non-lethal versions or otherwise creating built-up pressure in the grenade prior to detonation.

Moreover, integration of the retaining clip within the safety lever improves and simplifies manufacture and assembly of grenades incorporating same, but without sacrificing reliability.

These and other features and advantages will be readily apparent from the following Detailed Description, which should be read in conjunction with the accompanying drawings.

DETAILED DESCRIPTION

The following embodiments described herein relate to a grenade having a safety feature that is integrated directly within the handle or lever of the grenade. Throughout the course of discussion, various terms are used to aid in providing a suitable frame of reference with regard to the accompanying drawings. To that end, terms such as "above", "below", "top", "bottom", "upward", downward", "proximal", "distal" and the like are used throughout. These terms, however, are not intended to be overlimiting of the present invention as claimed. In passing, it should further be noted that the drawings which are provided in this application should not be necessarily relied upon in terms of their depicted scale.

Moreover, the embodiments described herein relate specifically to certain so-called "non-lethal" or diversionary weapons/devices or grenades that use a contained material to produce an audible or visual distraction or to otherwise impair or incapacitate individuals in the vicinity of the detonated grenade. It will be readily apparent that the concepts that are described herein, however, are also applicable to other forms of weaponry having an arming pin-actuated feature that is used in conjunction with at least one fuze or fuze assembly to effect detonation.

Figure 1:
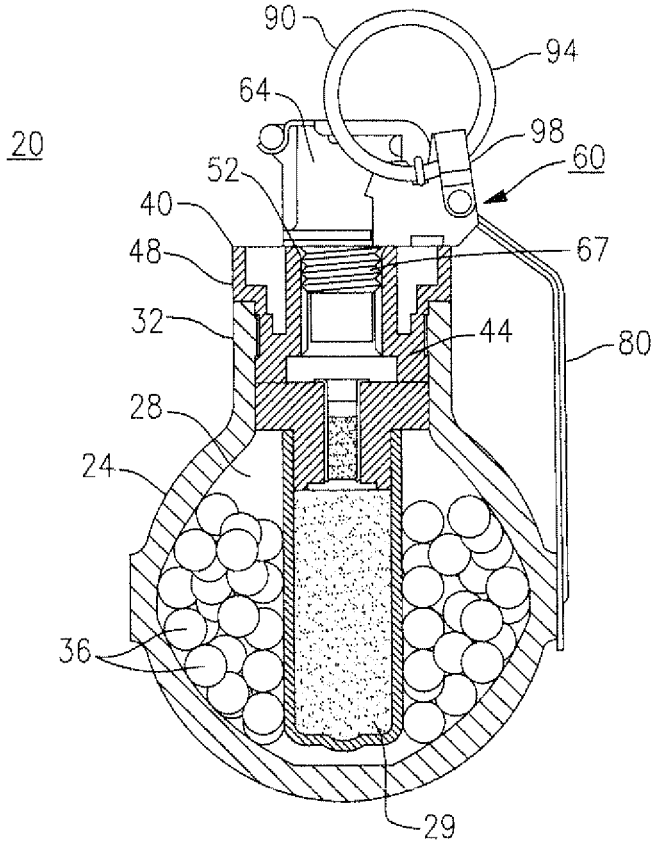
FIG.1 Prior Art
FIG. 1 is a side elevational view, shown in section, of a grenade made in accordance with the prior art.

Referring to FIG. 1 a grenade 20 made in accordance with the prior art is shown, the grenade being defined by a body or housing 24 having a suitable shape and including at least one interior chamber 28. In the present example, the housing 24 is defined by a substantially spherical configuration with the exception of a cylindrical neck or stem portion 32 having an open end 33. The entirety of the housing 24 and the stem section 32 is hollow, thereby permitting the inclusion of various components through the open end 33 of the cylindrical stem section. According to this version, the housing 24 and the stem section 32 are each preferably fabricated from a hardened rubber material in which the walls are substantially thickened to provide structural integrity while maintaining a level of elasticity.

As previously noted, the grenade 20 described herein is a so-called "non-lethal" or "diversionary" grenade. According to this exemplary version, a plurality of hardened (e.g., Durometer 70) rubberized pellets 36 are added as filler material within the hollow interior chamber 28 of the grenade housing 24. upon detonation of the grenade 20 these rubberized pellets 36 are dispersed at a high speed over a predetermined radius and are intended to stun or incapacitate persons within that radius. Alternatively, other materials such as those producing a light emitting or audible effect (referred to as a "flash-bang" grenade) could be utilized. A cap 40 is defined by a substantially cylindrical configuration and is engaged with the stem portion 32, the cap being made, according to this embodiment, from a plastic material and having a downwardly extending portion 44 that is sized to create an interference fit with the interior walls of the stem section 32 and an upper ledge 48 shaped to configure substantially to that of the exterior wall of the stem section when the cap is fitted thereto. As such, the cap 40 is releasably, though tightly attached to the grenade housing 24.

Figure 3:
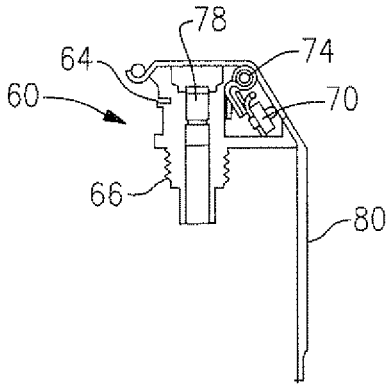
FIG.3 Prior Art
FIG. 3 is a partial sectioned view of a prior art fuze assembly for a grenade.

The cap 40 includes a center through opening or bore 52, the opening according to this embodiment including a set of screw threads (not shown) for receiving a portion of a fuze assembly 60, which is attached thereto. An example of a portion of a fuze assembly is shown in FIG. 3 for purposes of this description and to provide ample background.

The fuze assembly 60 is mounted to the cap 40 and includes a portion that extends into the interior chamber 28 of the body 24. According to this version, the fuze assembly includes a fuze body 64 having a downwardly extending portion 66 that is threaded over at least an axial portion thereof and complimentary to the screw threads of the central bore 52 of the cap 40 into which the portion is threadingly engaged. The fuze body 64 retains therein a striker 70, a striker spring 74 and a primer, wherein the fuze assembly further includes at least one charge so as to effect detonation of the grenade 20. A safety lever 80 or spoon is attached to the fuze body 64 in biased and overlaying fashion and is retained in place by means of an arming pin 90 that is also attached to the fuze body 64. The safety lever 80 extends downwardly from the fuze body 64 and is pivotally and releasably or hingably attached thereto, the lever substantially conforming to the fuze body 66 and the grenade body 24, respectively.

Figure 2:
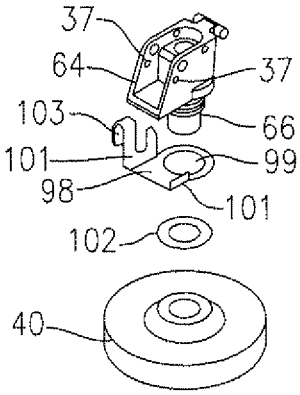
FIG.2 Prior Art
FIG. 2 is a partial, exploded view of the upper portion of a prior art grenade depicting the placement of a retaining clip used for maintaining the firing pin.
Figure 4:
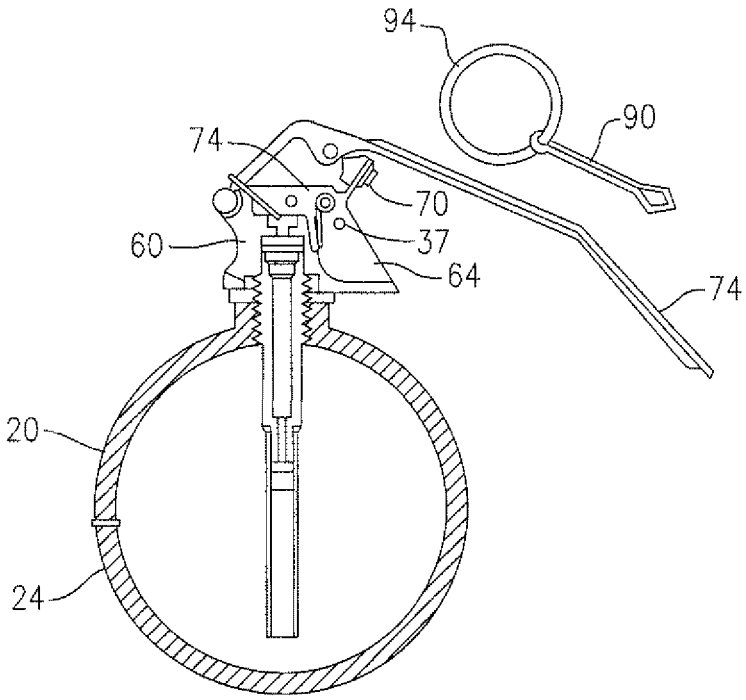
FIG.4 Prior Art
FIG. 4 is a side elevational view of a prior art grenade, similar to those of FIG. 1, shown at the time of release of the safety lever.

Because there is considerable risk of catastrophic injury that could develop if the arming pin 90 prematurely or unintentionally is pulled, a retaining clip 98 is further provided. As shown in FIG. 2, the retaining clip 98 is provided as a separate component and is disposed between the threaded portion of the fuse body 64 and the cap 40 of the grenade 20. The clip 98 is configured to retain a proximal ring portion 94, FIG. 4, of the arming pin 90, FIG. 4, thereby requiring both a transverse (twisting) motion followed by an axial (pulling) motion to effect the release of the arming pin and thereby effect release of the safety lever 80.

In operation and as noted, release of the arming pin 90 from the retaining clip 98 is effected by a twisting motion of the proximal ring portion 94 of the pin. As shown in FIG. 2, the clip 98 is made from aluminum or similar material and is preferably defined with a center opening 99 that is sized to be fitted over the downwardly extending portion 66 of the fuze assembly 64, the clip further having a pair of flanges 101 that are spaced to fit within opposing lateral side walls of the fuze body 64. A substantially C-shaped spring clip member 103 extends downwardly from one of the flanges 101, the spring clip defining a spacing that requires elastic deformation of the clip member to effect securement and release of the firing pin 90, FIG. 1, and more specifically the proximal ring portion 94, FIG. 1, thereof. A washer 102 is also placed beneath the retaining clip 98, thereby retaining the clip between the bottom of the fuze body 64 ad the top of the upper ledge of the cap 40. Once the firing pin 90 has been released from the retaining clip 98, it can be axially pulled away from the fuze body 64, through lateral openings 37 formed in the housing and lever 80, thereby releasing the safety lever 80. Typically and upon pulling the arming pin 90, the user immediately pushes the safety lever 80 toward the grenade body 24 and hurls the grenade 20 toward a target. Alternatively, the grenade 20 is enabled by apparatus (not shown) prior to launching of same in a manner that is known. As shown most clearly in FIG. 4, release of the safety lever 80 causes the lever to pivot under the action of the preloaded striker spring 74 and further causes the striker 70 to also pivot and axially engage the primer, causing an ignition spark. In the above-depicted apparatus, an ejection charge separates the cap 40 from the grenade body 24, followed by a delay charge after which the rubberized pellets 36 (not shown in this view, refer to FIG. 1) and a high intensity illumination (flash) and/or sonic charge 29, FIG. 1, are dispersed.

Figure 5:
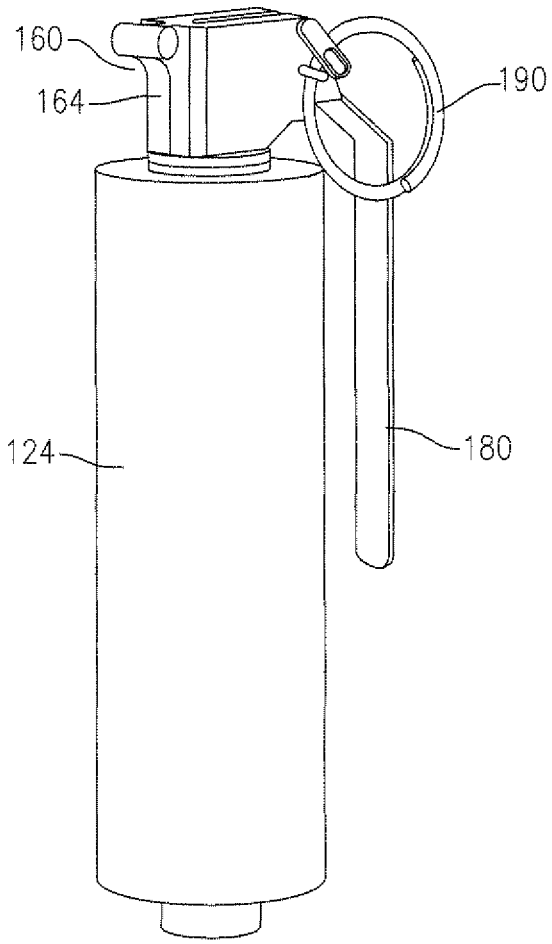
FIG.5 Prior Art
FIG. 5 is a side elevational view of another form of prior art grenade.
Figure 6:
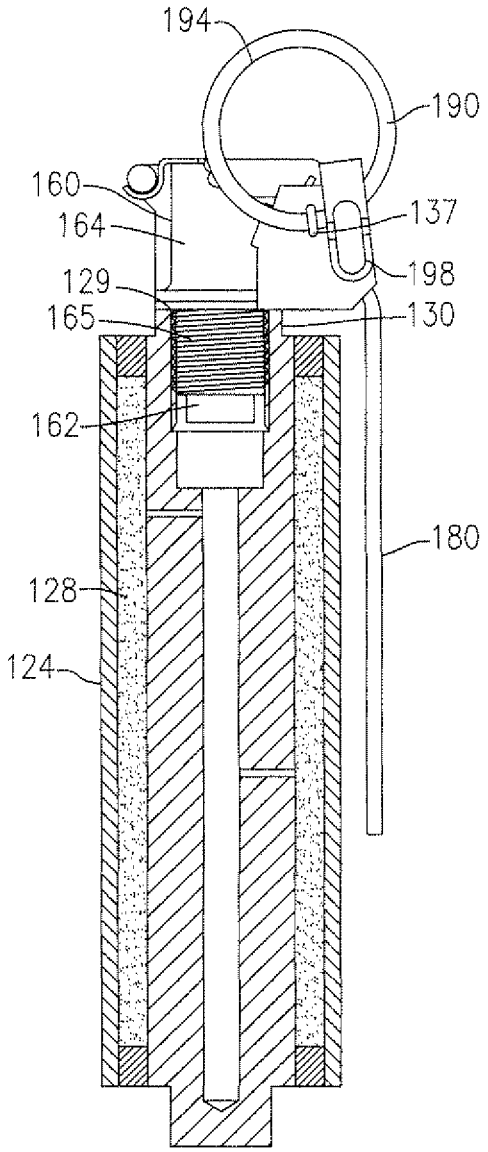
FIG.6 Prior Art
FIG. 6 is a sectioned view of the prior art grenade of FIG. 5.
Figure 8:
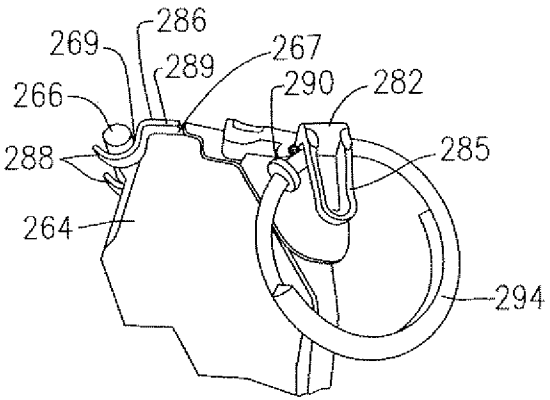
FIG. 8 is an enlarged view of the upper portion of the diversionary grenade of FIG. 7.
Figure 7:
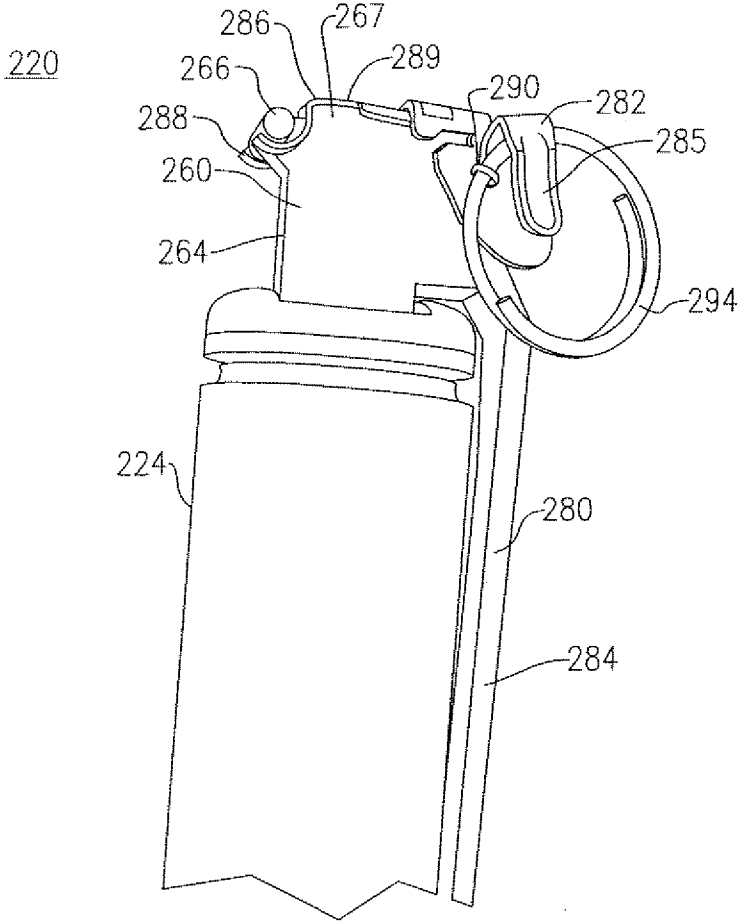
FIG. 7 is a side elevational view of a diversionary grenade configured with a safety lever in accordance with a first embodiment.
Figure 9:
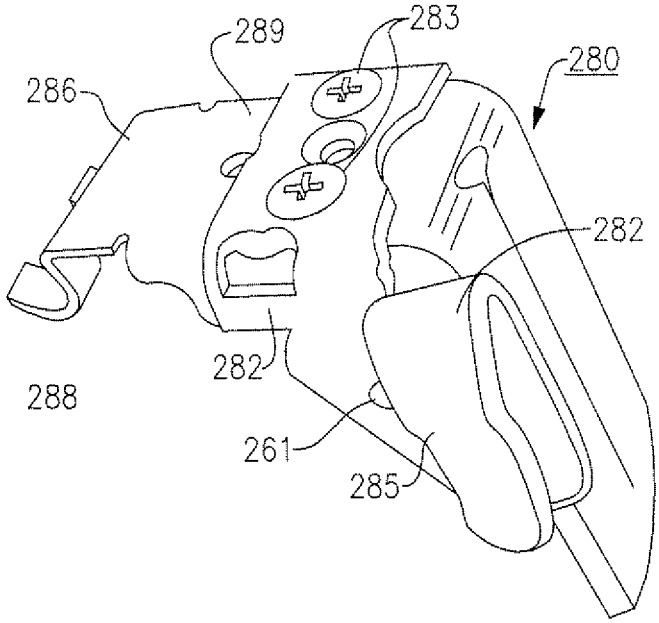
FIG. 9 is a partial top perspective view of a portion of the safety lever depicted in FIGS. 7 and 8.

Turning to FIGS. 5 and 6, there is depicted another example of a non-lethal grenade 120 made in accordance with the prior art. This grenade 120 is defined by a body or housing 124 having a suitable shape and including at least one interior chamber 128. The body 124 according to this embodiment can be made from aluminum or other suitable structural material. It should be noted that the body 124 can be fabricated from a single component as depicted herein or constructed using multiple sections. The body 124 depicted herein according to this version is in the form of a canister, having a cylindrical cross section and including an upper or top opening 129 that extends into the interior of the body 124. The top opening 129 is further defined by a threaded axial section 130.

A fuze assembly (partially shown) 160 is configured to fit onto the top opening 128 of the grenade body 24, the fuze assembly according to this embodiment being a Model 201, Pyrotechnic Delay fuze including a fuze body 164 having a downwardly extending portion 162 having a set of external threads 165 that are conformed in terms of pitch and to complement that of the threaded axial section 130 and to permit threaded engagement therebetween. Representative fuze versions are more completely described, by way of example, in U.S. Pat. Nos. 4,926,752, 5,196,649 and 5,654, 523.

A safety lever 180 includes an upper end that is pivotally and biasedly attached to the fuze assembly 160, wherein an arming or firing pin 190 is attached through a pair of axially aligned lateral openings 137 (only one shown in this these figures) formed in the fuze assembly 160 to prevent premature movement of the lever. The arming pin 190 is a cotter pin or other suitable pin-like member having a proximal ring portion 194 that is engaged by a retaining clip 198. The retaining clip 198 according to this prior art version similar to that shown previously in FIG. 2 is defined by a separate component that includes an opening 99, FIG. 2, sized to permit the downwardly extending portion 162 of the fuze assembly 160 to pass therethrough and a substantially C-shaped spring clip 103, FIG. 2, member extending downwardly from a flange 101, FIG. 2. In assembly, the retaining clip 198 is sandwiched between the bottom of the fuze body 164 and the top end of the grenade body 124.

In operation and similarly to the preceding example, the retaining clip 198 and more specifically the C-shaped member 103, FIG. 2 retains a proximal ring portion 194 of the arming pin 190, preventing movement of the safety lever 180. In order to use the grenade 120, the arming pin 190 must first be released from the lateral openings 137 through deliberate rotation of the proximal ring portion 194 until the ring is released by retaining clip 198. The arming pin 190 can then be pulled from the lateral openings 137 of the fuze assembly 160 and lever 180 and removed from the grenade 120.

With the arming pin 190 removed, the unlocked safety lever 180 is now pushed inwardly toward the body by the user. Upon either throwing (release) of the grenade 120 by hand (not shown) or by a launching apparatus (not shown), the safety lever 180 is caused to pivot based upon the presence of a biasing spring 74, FIG. 4, releasing the striker 72, FIG. 4, which pivots as shown by way of example in FIG. 4, to engage the fuze assembly 160 and detonates the grenade 120. More specifically, engagement of the fuze assembly 160 initiates a timed delay of typically a few (e.g., 1.5-3) seconds, after which the grenade 120 is detonated, releasing in this instance an illumination (flash) discharge of approximately 4-6 million candela and an audible discharge of 160 decibels. Detonation in this instance causes the fuze assembly 160 to be blown clear of the grenade body 124 in order for the contents of the grenade 120 to be properly dispersed and causes the retaining clip member 198, according to this embodiment, to also be blown clear as a projectile.

Referring to FIGS. 7-10, there is shown a grenade made in accordance to a first exemplary embodiment. The grenade 220 is defined by a housing or body 224 made from aluminum or other suitable material that further includes an interior enclosure that can retain a filler material, such as rubberized pellets, illumination (flash/bang) charge, chemical agents or the like (not shown). As in the preceding and to facilitate discussion, the grenade body 224 is similarly constructed to that previously described; that is, in a canister-like configuration and having a substantially cylindrical cross section. The grenade body 224 includes an interior chamber 228 and an upper or top opening (not shown, but similar to that previously depicted in FIG. 6) that further is defined by an axial threaded portion (also not shown in these views, but similar to that depicted in FIG. 6).

A fuze assembly 260, such as an M201 Pyrotechnic fuze according to this embodiment or other suitable assembly, is attached to the grenade body 224, the fuze assembly includes a downwardly extending portion (not shown) having a set of external threads that correspondingly match those of the axial threaded portion at the top of the grenade body 224. The fuze assembly 260 further includes a striker and striker spring similar to those shown in FIGS. 3 and 4 as well as an initial charge to create a time delay. It will be readily apparent at other fuze assemblies can be used in accordance with this invention wherein the form of fuze assembly is not intended to be restricted by the concepts described herein.

According to this grenade version, a safety lever 280 is pivotally and biasedly attached to the grenade body 224, the lever including a lower handle portion 284 extending substantially along and conforming to the side of the grenade body 224. The safety lever 280 further including a distal end 286 that includes a pair of hinge members 288, spaced from one another and extending downwardly in a concave manner from a top surface 289 of the safety lever. The hinge members 288 are configured to engage with a bar 266 projecting from the top surface 267 of the fuse assembly 260, the bar being separated from the top surface of the fuse assembly by a tab 269 having a width that is that is marginally larger than the spacing between the hinge members 288 of the safety lever 280 in order to permit pivotal engagement therewith.

The safety lever 280 further includes an integrated retaining clip 282. According to this version, the clip 282 is fastened using screws 283 or otherwise attached to the top surface 289 of the safety lever 280, but the clip can be alternatively attached or integrated into the lever itself as a single component. The clip 282 is further defined according to this embodiment by a substantially C-shaped spring clip section 285 having a spacing that is sized to securably but releasably retain the proximal ring portion 294 of an arming pin 290. The arming or firing pin 290, when positioned in the lateral opening 261, FIGS. 9, 10, of the fuze assembly 260 and safety lever 280 prevents the safety lever from movement and maintains same in a biased first position.

To remove the firing pin 290, the proximal ring portion 294 must first be rotated out of engagement with the retaining clip 298. The presence of the integrated retaining clip 282 does not interfere with the intended operation of the grenade 20 as the safety lever 280 is gripped by the user (not shown). The grenade 220 can be launched, releasing the safety lever 280 which causes the lever, including the integrated retaining clip 298, to be moved into a firing position in which the striker is moved on axis is with the primer of the fuze assembly 260, permitting detonation of the grenade and in which the safety lever 280 falls harmlessly to the ground following its release based on the hinged attachment thereof to the grenade 220.

Figure 12:
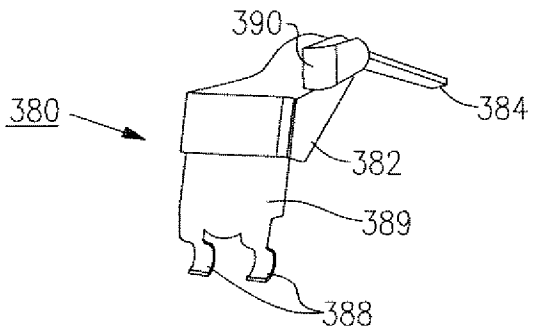
FIG. 12 is a top view of the safety lever of FIG. 11.
Figure 11:
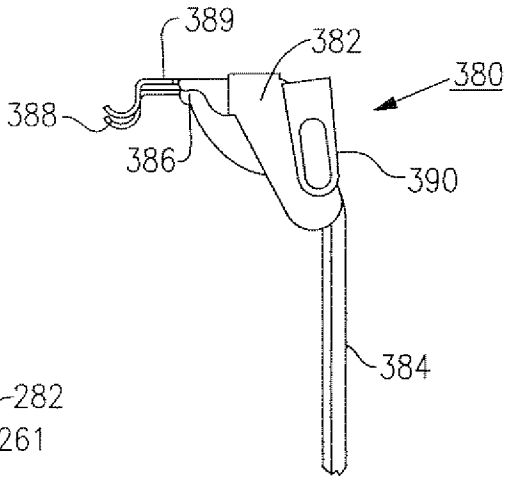
FIG. 11 is a side elevational view of an integrated safety lever made in accordance with a second exemplary embodiment.
Figure 10:
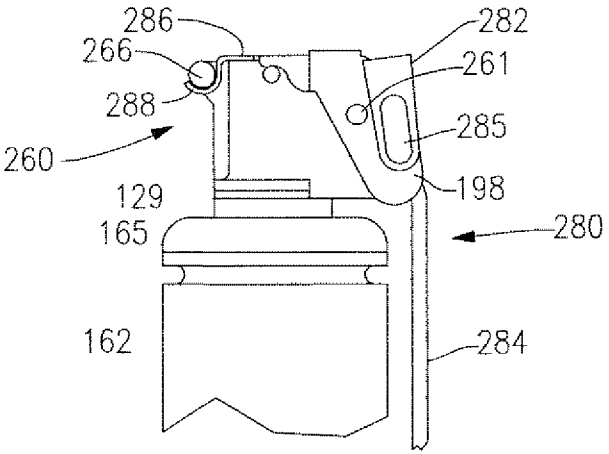
FIG. 10 is a partial side perspective view of the diversionary grenade of FIGS. 7-9 with the firing pin removed.

A second embodiment of a safety lever 380 with an integrated safety clip is shown in FIGS. 11 and 12 which is attached to the upper end of a grenade body (not shown). As in the preceding version, the safety lever 380 includes a lower handle portion 384 as well as a distal end 386 that includes a pair of hinge members 388, each of the hinge members being spaced from one another and extending downwardly in a concave manner from a top surface 389 of the lever. An integrated retaining clip 382 is provided on the safety lever 380 by press fitting on to the top surface 389 of the lever. The retaining clip 382 includes a clip section 390 that permits the attachment of an arming pin (not shown). The operation of this embodiment is the same as that previously described.

PARTS LIST FOR FIGS. 1-12

20 grenade
24 body or housing
28 interior chamber
32 stem section
36 rubberized pellets
40 cap
44 downwardly extending section
48 upper ledge
52 center bore
60 fuze assembly
64 fuze body
70 striker
74 striker spring
78 primer
80 safety lever
90 arming pin
98 retaining clip
99 opening
101 flanges
102 washer
103 spring clip member
120 grenade
124 body or housing
128 interior chamber
129 opening, top
130 top opening
160 fuze assembly
162 downwardly extending portion
164 fuze body
180 safety lever
190 arming pin
194 proximal ring portion
198 retaining clip member
220 grenade
224 body or housing
260 fuze assembly
261 lateral opening
264 fuze body
266 bar
267 top surface, fuze body
269 tab
280 safety lever
282 retaining clip
283 screws
284 lower or proximal handle portion
285 spring clip section
286 distal end
288 hinge members
289 top surface, lever
290 arming/firing pin
294 proximal ring portion
380 safety lever
382 retaining clip
384 lower handle portion
386 distal end
388 hinge members
389 top surface
390 clip section, C-shaped It should be readily apparent that other variations and modifications are possible utilizing the inventive concepts described herein and according to the following claims.

The invention claimed is:

1. A grenade comprising:
a grenade body having at least one interior chamber;
a fuze assembly attached to said grenade body, said fuze assembly having means for detonating said grenade;
a safety lever movable between a first position and a second position which engages said fuze assembly;
a firing pin engageable with said fuze assembly and said safety lever to prevent said safety lever from being moved to said second position, the firing pin having a proximal ring and defined by a longitudinal axis; and
a retaining clip retaining said firing pin and preventing premature release of said firing pin from said grenade, said retaining clip being integrated into said safety lever and including a portion which is disposed above a top surface of the safety lever and edge sections that downwardly extend over the top surface, one of the edge sections including an inverted U-shaped clip that is offset from the longitudinal axis of the firing pin that receives a portion of the proximal ring of the firing pin.

2. A grenade as recited in claim 1, wherein said grenade is a non-lethal grenade.

3. A grenade as recited in claim 1, wherein said retaining clip is fastened to the top surface of said safety lever.

4. A grenade as recited in claim 1, wherein said retaining clip is fabricated as part of the safety lever.

5. A grenade as recited in claim 1, wherein said safety lever is caused to release from said grenade body when moved to said second position.

6. A safety lever for a grenade, said safety lever comprising means for engaging a fuze assembly of said grenade and a retaining clip member for retaining a firing pin of said grenade, the retaining clip member having an upper portion disposed onto a top surface of the safety lever and edge portions that downwardly extend over the top surface, one of the edge portions having an inverted U-shaped clip that is configured to retain a proximal ring of the firing pin.

7. A safety lever as recited in claim 6, wherein the upper portion of the retaining clip member is fastened to the top surface of the safety lever.

8. A safety lever as recited in claim 7, wherein the upper portion of the retaining clip member is welded to the top surface of the safety lever.

9. A safety lever as recited in claim 6, wherein said safety lever includes means for hingably attaching to the fuze assembly of said grenade, said safety lever being movable between a first position and a second position.

10. A safety lever as recited in claim 6, wherein the retaining clip member is integral to the safety lever.

* * * * *